US006153079A

United States Patent [19]

Klam et al.

[11] Patent Number: 6,153,079

[45] Date of Patent: Nov. 28, 2000

[54] AQUEOUS ELECTRODEPOSITION BATH BASED ON CHLORIDES FOR PREPARATION OF A COAT BASED ON ZINC OR ZINC ALLOY

[75] Inventors: Geneviève Klam, Uckange; Isabelle Marolleau, Basse Ham; Jacques Petitjean, Manom, all of France

[73] Assignee: Sollac, Puteaux, France

[21] Appl. No.: 09/105,203

[22] Filed: Jun. 26, 1998

[30] Foreign Application Priority Data

Jun. 26, 1997 [FR] France ..... 97 07985

[51] Int. Cl.[7] ..... C25D 3/22

[52] U.S. Cl. ..... 205/141; 205/138; 205/305; 524/435

[58] Field of Search ..... 524/435; 205/141, 205/138, 305

[56] References Cited

U.S. PATENT DOCUMENTS

| | | | |
|---|---|---|---|
| 3,909,373 | 9/1975 | Creutz | 205/310 |
| 4,384,930 | 5/1983 | Eckles | 205/253 |
| 4,512,856 | 4/1985 | Paneccasio | 205/314 |
| 5,525,207 | 6/1996 | Becking | 205/244 |
| 5,575,899 | 11/1996 | Nakakoji et al. | 205/246 |

FOREIGN PATENT DOCUMENTS

| | | |
|---|---|---|
| 0 538 081 | 4/1993 | European Pat. Off. . |
| 2 732 365 | 10/1996 | France . |
| 83 136793 | 8/1983 | Japan . |

OTHER PUBLICATIONS

Chemical Abstracts, vol. 100, No. 14, "Acidic Zinc Plating Bath", Nippon Mining Co., Ltd., Apr. 2, 1984.

*Primary Examiner*—David W. Wu
*Assistant Examiner*—Ling Siu Choi
*Attorney, Agent, or Firm*—Oblon, Spivak, McClelland, Maier & Neustadt, P.C.

[57] ABSTRACT

A bath of pH higher than 4 containing more than 1 mole/liter of $Zn^{++}$ ions and at least one polyethylene glycol polymer of the general formula $R^1—O(CH_2—CH_2—O)_n—R^2$, in which $n \leqq 13$ and in which the concentration of polymer in the bath is adapted to incorporate in the coat an organic compound having a content by weight greater than 0.1%, expressed as weight of carbon per unit weight of the coat. The bath is adapted to high current densities, and the coat applied on the steel sheet imparts both a leveling effect and an improvement of corrosion resistance.

9 Claims, 3 Drawing Sheets

ZN-PEGbiCOOH600 at 0.3%

AQUEOUS ELECTRODEPOSITION BATH BASED ON CHLORIDES FOR PREPARATION OF A COAT BASED ON ZINC OR ZINC ALLOY

The present invention relates to a zinc electroplating bath based on chlorides, to a process for electrodeposition in this bath of a corrosion-protection coat based on zinc or zinc alloy on a metal surface, especially on a steel surface, as well as to a substrate, especially of steel, protected against corrosion by a coat produced by means of said process.

The invention attempts to overcome two problems at the same time: reducing the roughness of coated sheets while improving the corrosion resistance thereof.

The first problem therefore relates to roughness: in fact, after electrolytic coating of a metal substrate, especially a steel sheet, with zinc or zinc alloy, it is observed that the roughness of the coat may be different from the initial roughness of the substrate.

Surface roughness can be evaluated in the following classical manner: a plurality of profilometric recordings (or "profiles") of the surface are made, each profile being filtered during the recording process by means of a high-pass electronic filter which reduces the amplitude of the undulations exceeding a predetermined filtering threshold, for example to 75% of its value in the profile after filtering (the filtering threshold is 0.8 mm, for example); the vertical scatter of this profile, or in other words the distribution of the recorded depth relative to a given reference line (Ox), is then plotted in accordance with French standards (AFNOR EO5.015/017/052), this reference line (Ox) being the line drawn parallel to the general direction of the profile and passing through its upper points; on the ordinate (Oz), which is drawn perpendicular to Ox, there are plotted the depths of the profile; the deviation of the roughness profile relative to the reference line Ox can be regarded as a random variable, and the set of deviations or depths then forms a statistical distribution, from which the position of the man line of the profile and the arithmetic average deviation of the depth relative to the main line are then calculated; this arithmetic average deviation is called the arithmetic average roughness $R_a$.

Measurements of roughness $R_a$ generally reveal that the roughness of the coat is greater than that of the initial substrate, especially when electrolysis baths based on chloride are used and especially when the coat is applied at "elevated" current densities.

An "elevated" current density is defined as any current density higher than $0.25\times J_{lim}$.

$J_{lim}$ is the limiting current density, which corresponds to the current density plateau on the characteristic "intensity-potential" curve of a zinc electroplating bath for a given relative velocity of the bath relative to the surface to be zinc electroplated.

$J_{lim}$ therefore corresponds to the current density for which the local concentration of zinc ions of the bath becomes zero in the immediate vicinity of the sheet to be coated.

$J_{lim}$ also corresponds to the current density at which electrochemical phenomena other than the reduction of zinc ions, especially evolution of hydrogen, begin to appear on the surface to be zinc electroplated.

$J_{lim}$ therefore also corresponds to the current density at which the electrochemical (or faradic) yield of zinc deposition begins to drop appreciably.

Thus, in the range of low current densities (below $0.25\times J_{lim}$), it is known that the roughness of the coat depends substantially on the grain size of the electrodeposited layer.

Conversely, in the range of high current densities (above $0.25\times J_{lim}$), which corresponds to the most common industrial conditions and to those of the invention, it is known that the roughness of the coat depends substantially on the roughness of the substrate.

The boundary between these two behavior ranges depends on the value of $J_{lim}$, or in other words on the bath composition and on the hydrodynamic use conditions.

In industrial installations, the search for productivity has motivated electrodeposition at the highest possible current densities; since the maximum current density usable in practice depends on $J_{lim}$, it is advisable to adapt the bath composition to increase the value of $J_{lim}$; it is for this reason, among others, that there are used baths of high ionic concentration, especially concentration of $Zn^{2+}$ ions (in the case of zinc electroplating).

Thus, a current density above 50 $A/dm^2$ is considered to be "elevated" for a classical zinc electroplating bath based on chlorides and containing more than 1 mole/liter of $Zn^{2+}$ ions used under classical hydrodynamic conditions.

In a bath of this type, the concentration of Cl— ions may exceed 5 mole/liter.

The roughness increase obtained after electrodeposition, known as "roughness gain" $\Delta R_a$, may be on the order, for example, of 0.5 $\mu$m for an initial substrate roughness $R_a$ on the order of 1.3 $\mu$m.

In the prior art, it has been proposed that additives designed to reduce this roughness gain be included in the zinc electroplating bath, such additives therefore being known as "leveling agents".

Among the known additives to be included in electrodeposition baths there can be distinguished classically the "leveling agents", the "brightening agents", the "refining agents" and the "wetting agents" (also known as "surfactant agents").

The effect of these additives often depends on the conditions of use of the bath, especially the current density applied during the coating process.

A "leveled" or "bright" electrodeposited coat generally has a fine-grained structure; on the other hand, an electrodeposited coat with "refined" structure is neither "bright" nor "leveled".

In general, therefore, a "leveling agent" or a "brightening agent" is also a "refining agent".

A "brightening agent" is not necessarily "leveling" or necessarily "wetting".

A "leveling agent" is not necessarily "brightening" or necessarily "wetting".

As an example of use of these different agents, U.S. Pat. No. 4,229,268 describes zinc electroplating baths based on chlorides and usable over a broad range of values of current density.

These baths contain leveling and brightening agents of general formula $R—S—(R'—O)_nH$ or $S[(R'O)_nH]_2$.

The supplementary addition of brightening agents chosen from among the acetophenones, for example, may also reinforce the leveling effect.

The properties of the coat obtained can be further improved by adding polyoxyalkylated napththols to the bath.

Finally, wetting agents (or surfactants) such as copolymers of ethylene oxide and propylene oxide can also be added to the bath; good results have been observed in particular with polyethylene glycol condensates of general formula $H—O—(CH_2—CH_2—O)_n—H$, especially for which n is about 20 to 24 and the average molecular weight is between 950 and 1050 g, or n is about 68 to 85 and the average molecular weight is between 3000 and 3700 g.

French Patent 2597118 describes electrodeposition baths for coats of zinc alloy (Zn—Ni) based on chlorides or sulfates that can be used at current densities as high as 215 $A/dm^2$.

As brightening agent there are used polyoxyalkylene compounds such as copolymers of alkylene oxides and groups $R^1$ and $R^2$ of general formula $R^1—O—(CH_2—CH_2—O)_n—R^2$ in which n=10 to 50 and;

$R^1=CH_3—(CH_2)_x—CH3$ and $R^2=H$, with x between 9 and 15, or $R^1=H—(CH_2)_x—Ar$ and $R^2=—CH_2—CH_2—OH$, with x between 6 and 15, while Ar denotes a benzene ring.

These brightening agents therefore have a structural refining effect on the coat; they are used in baths at fairly low concentrations of between 0.02 and 5 g/l; a leveling effect is not described.

European Patent 0285931 describes electrodeposition baths generally based on sulfates for coats of zinc alloys (Zn—Cr) which also contain polyoxyalkylene compounds; such additives in this case are "incorporation agents" designed to favor homogeneous incorporation of chromium (between 5 and 40%) in the coat and to improve the "color" appearance of the coat, such that grayish-black or grayish-white colors are avoided.

Similarly, European Patent 0342585 also describes electrodeposition baths for coats of zinc alloy (Zn—Cr) based on sulfates, which contain polymers in which "quaternary amine" functions are grafted to the repeating unit for the purpose substantially of favoring incorporation of chromium (between 5 and 30%) in the coat.

These cationic polymers are dissolved in the bath at concentrations of between 0.005 and 5 wt %.

The effect of these polymers in solution is to favor precipitation of chromium during electrodeposition, and together therewith they are coprecipitated in very low proportion, thus improving the powdering resistance of the coat.

The content of cationic polymer in the coat obtained may therefore reach 5%.

U.S. Pat. No. 4,146,442 describes zinc electroplating baths based on cyanides (basic) or sulfates or chlorides (acid) which can be used at relatively low current densities (up to 15 $A/dm^2$).

These baths contain polyglycol wetting agents at concentrations of between 3 and 5 g/l.

Thus polyethylene glycol polymers without substituents or with substituents at only one end can be used as "wetting agents" or "surfactants" in the electrodeposition baths, especially for zinc electroplating.

Polyethylene glycol compounds substituted at one end at least can be used as "brightening agents" in these same electrodeposition baths.

The polyethylene glycols used here as wetting or brightening agents contain an elevated number of ethylene oxide units per molecule, at least equal to 10 and generally in excess of 20.

These polymers can also be used in baths for electrodeposition of Zn—Cr alloy, where they facilitate incorporation of chromium in the deposit.

U.S. Pat. No. 5,575,899 (corresponding to French Patent 273966) describes an aqueous electrodeposition bath based on chlorides for preparation of a coat of zinc-nickel alloy, containing in the solution:

polyethylene glycol as nonionic surfactant agent (which is therefore a wetting agent), possessing a molecular weight lower than in the foregoing, in this case between 400 and 800 g/mole, in a concentration of between 0.01 and 1 g/l;

at least one compound possessing a lone pair of electrons chosen from the group comprising nicotinic acid, urea, thiourea, nicotinamide, thioglycolic acid and sodium thiosulfate in a concentration of between 0.001 and 1 g/l.

The molar concentration of ions of zinc or zinc alloy is preferably such that $1 \leqq (|Zn^{2+}|+|Ni^{2+}|) \leqq 4$ mole/l, $|Cl^-|>4$ mole/l.

Zn—Ni is preferably electrodeposited by using this bath at a current density of between 50 and 150 $A/dm^2$.

According to that document, the function of the polyethylene glycol is to improve the wettability of the surface to be coated; the choice of molecular weight is the determining factor: below 400 problems of scorching are encountered at the edges, whereas above 800 the incorporation of nickel in the Zn—Ni deposit decreases substantially.

This document describes mainly a means to prevent:

the development on the coated surface of needle-shaped spots resulting from heterogeneities in the flow of the bath over the surface of the sheet, scorching on the edges of the coated sheet.

Thus the "compound possessing a lone pair of electrons" is designed to prevent the growth of crystals deposited in the portions of the surface where the flow of the bath is irregular, "given that the lone pair of electrons is adsorbed on the surface"; a compound containing C═C bond (double) is used preferably.

None of the documents cited hereinabove describes the use of polyethylene glycol as leveling agent, U.S. Pat. No. 4,229,268, already cited, describes as leveling agent a compound of the type $R—S—(R'—O)_nH$ or $S[(R'O)_nH]_2$, where R' is an alkylene radical and n is equal in particular to 2; the disadvantage of such a leveling agent lies on the one hand in its unpleasant odors and its toxicity and on the other hand in its low solubility in electrodeposition baths with high salt concentrations, such as zinc electroplating baths based on chlorides and usable at elevated current densities.

The object of the invention is therefore to provide a leveling agent for zinc electroplating baths that does not exhibit these disadvantages.

The second problem which the invention attempts to solve therefore relates to improving the corrosion resistance of steel sheets: the classical approach for such a purpose is to apply thereto an electrodeposited protective metal coat, especially a coat based on zinc or zinc alloy.

For well defined electrodeposition conditions, the protection efficacy is generally proportional to the thickness of the coat.

Conversely, for given coat thickness, electrodeposition conditions are sought which permit the maximum protection efficacy to be achieved.

To evaluate the protection efficacy imparted by a protective coat of known thickness E on a given substrate, it is possible to proceed as follows:

There is treated an electrochemical cell having as anode the specimen to be tested (substrate+coat), as cathode a plate of the same nature as the substrate (uncoated), and as electrolyte an aqueous sodium chloride solution having a concentration of 0.03 mole/liter, after which the electric discharge current of the said cell is measured as a function of time; the time $T_p$ at the end of which the discharge current drops suddenly to a much lower level is recorded (this sudden current drop corresponds to the occurrence of corrosion of the specimen in the form of red rust); this time $T_p$ therefore corresponds to the duration of corrosion protection which the coat imparts to the substrate: since the duration of protection is proportional to the coat thickness, the time $T_p$ is divided by the thickness E; the value obtained $T_{ps}=T_p/E$, is specific to the nature of the coat and can be regarded as indicative of the specific protective efficacy of the coat.

European Patent 0472204 describes a coat for protection against corrosion based on zinc or zinc alloy, containing 0.001 to 10% (expressed as carbon) of an acrylic or methacrylic polymeric compound of the formula $—CH_2—CRR'—CO—X—(CH_2)_n—NR'R'''$, in which X=NH or O.

The polymeric compound preferably has high molecular weight, greater than 1000, to avoid forming problems; the molecular weight must nevertheless be lower than 1000000 to permit sufficient dissolution of the compound in the zinc electroplating bath.

This "composite" coat offers good forming ability and in particular good paintability (adherence and protective efficacy of the paint layer), but does not exhibit noteworthy specific protective efficacy.

To prepare such a coat, there are used aqueous zinc electroplating baths having pH below 4.

The advantage of this organic compound in solution in the electrodeposition bath is that it permits the location of the electric current due to surface roughness of the substrate to be controlled, and it may thus contribute to preparation of soft and uniform surface coats, and even uniformly bright surfaces.

The concentration of this organic compound in the bath must not be too high, however, in order to avoid increasing the viscosity too appreciably; an increase in viscosity would make it impossible to recreate the hydrodynamic conditions necessary for use of elevated current densities.

The examples given in this document indicate that, depending on the concentration of polymer dissolved in the electrodeposition bath, the carbon content in the coat obtained varies, for example, as follows: 0.2 g/l, 7 g/l and 10 g/l in the bath yield respectively 0.01%, 0.6% and 0.7 to 0.8% of carbon in the coat.

Apart from the fact that the addition of acrylic or methacrylic polymeric compounds to a zinc electroplating bath does not increase the specific protective efficacy of the coat obtained by this bath in this case, the use of these compounds in baths based on chlorides whose pH must always be higher than 4 to offer good faradic yields cannot be envisioned.

Other reasons why the use of these compounds cannot be envisioned are that, in order to be able to apply the coat of zinc or zinc alloys at elevated current densities, it is advisable for the bath to contain high concentrations of soluble salts (KCl, $ZnCl_2$, etc.) and that, in such baths, the acrylic or methacrylic polymeric compounds are no longer sufficiently soluble to be incorporated in the coat during electrodeposition.

In the case of deposits of zinc alloys and nickel such as described in U.S. Pat. No. 5,575,899 by means of a bath based on chlorides at elevated current density (50 to 150 $A/dm^2$), no improvement of the specific protective efficacy is observed (see results presented in Example 10), due to the fact in particular that a "compound possessing a lone pair of electrons" is present in the bath, and despite the presence of polyethylene glycol in the bath.

Incidentally, only four examples (ex. 4, comparison ex. 2, ex. 13, comparison ex. 6) in that document use a polyethylene glycol of average molecular weight below 600; the fourteen other examples and the six other comparison examples generally use polyethylene glycol of average molecular weight equal to 600 and sometimes higher than 600 (750 in Example 14).

As it happens, comparison example 1 hereinafter clearly shows that the addition of a polyethylene glycol polymer of average molecular weight on the order of 600 in the electrodeposition bath does not have any significant effect on the specific protective efficacy imparted by the coat (of pure zinc in this case), even in the absence of a "compound possessing a lone pair of electrons".

The object of the invention is to provide a leveling agent for zinc electroplating baths based on chlorides, making it possible to obtain, with good faradic yield and at elevated current densities, coats having substantially improved specific protective efficacy against corrosion.

The object of the invention is an aqueous electrodeposition bath based on chlorides for preparation of a coat based on zinc or zinc alloy, wherein the pH is higher than 4, wherein the molar concentration of ions of zinc or zinc alloy is higher than 1 mole/liter, which does not contain any "compound possessing a lone pair of electrons" chosen among the group comprising sodium thiosulfate, nicotinic acid, urea, thiourea, nicotinamide and thioglycolic acid, which contains in solution at least one polyethylene glycol polymer of general formula $R^1—O—(CH_2—CH_2—O)_n—R^2$. characterized in that:

firstly, $n \leqq 13$, secondly, the concentration of the said polymer in the bath is adapted to incorporate in the said coat an organic compound in a content greater than 0.1 wt %, expressed as weight of carbon per unit weight of the said coat, thirdly:

either $R^1$ and/or $R^2$ are hydrogen atoms and the said polymer has an average molecular weight lower than 500 g/mole, or $R^1$ and $R^2$ are terminal substituent groups of the chain, and may be different or identical, chosen from among:

the unsubstituted alkyl ($—C_mH_{2m+1}$), alkene ($—C_mH_{2m-1}$) or alkyne ($—C_mH_{2m-3}$) groups, the alkyl ($C_mH_{2m}—R^3$), alkene ($C_mH_{2m-2}—R^3$) or alkyne ($C_mH_{2m-4}—R^3$) groups substituted in terminal position, in which $—R^3$=—O—$R^4$ (ethers or "oxy"), —COO—$R^4$ (esters or "carboxy") or —COOM (carboxylic acid salt), $—SO_3—R^4$ ("sulfonyl") or —SO3—M (sulfonic acid salt), —CO—$R^4$ (ketone), —N=$R^4$ or —N<$_{R^5}^{R^4}$ (amine), —S—$R^4$ ("thio"), or —C≡N (nitrile), in which $R^4$, $R^5$ is chosen from among H or an alkyl ($—C_mH_{2m+1}$), alkene ($—C_mH_{2m-1}$) or alkyne ($—C_mH_{2m-3}$) group, the value of m being sufficiently low that the said polymer is soluble at the said concentration in the bath.

The bath according to the invention may also have one or more of the following characteristics:

the average molecular weight of the said polymer is greater than 150 g/mole, the concentration of the said polymer in the bath is between $10^{-4}$ and $10^{-1}$ mole/liter, $R^1$ and $R^2$ are hydrogen atoms, $R^1$=$R^2$=$—CH_2—COOH$.

It is considered that the bath does not contain any "compound possessing a lone pair of electrons" as soon as the measured concentration is below 0.001 g/l.

Another object of the invention is a process for electrodeposition of a coat based on zinc or zinc alloy on a strip of steel sheet wherein:

the said sheet is made to travel through an electrodeposition bath according to the invention, and an electrodeposition electric current is passed between the said strip acting as cathode and at least one anode disposed in the said bath opposite the said strip, characterized in that the mean current density, measured on the portion of the said strip facing the at least one anode, is higher than $0.25 \times J_{lim}$, where $J_{lim}$ is the limiting current density, which corresponds to the current density plateau on the characteristic "intensity-potential" curve of the said zinc electroplating bath for a given velocity of travel of the said strip relative to that bath.

Yet another object of the invention is a steel sheet coated with a corrosion protection layer based on zinc or zinc alloy prepared by the process according to the invention, characterized in that the said layer contains more than 0.1 wt %, preferably more than 0.65 wt % (expressed as carbon) of an organic compound.

In the thickness of the said layer and outside the steel-layer interface zone, the carbon content is preferably higher than or equal to 0.5 wt %.

The carbon content can be measured by glow discharge spectroscopy so as to obtain a curve "C" of variation of the carbon content in the thickness of the said layer, as illustrated in FIG. 4, which relates to Example 6; the "carbon content in the thickness of layer outside the steel-layer interface zone" is defined as the carbon content measured on this curve "C" without taking into account the interface peak "Ci" described in Example 6.

BRIEF DESCRIPTION OF THE DRAWINGS

The invention will be better understood by reading the description hereinafter, given by way of non-limitative example and with reference to:

(FIGS. 2 and 3: according to the invention) on a scale increasing from 0 to 0.27 in increments of 0.03, and as abscissa the clamping pressure to produce friction on a scale increasing from 0 to $800 \times 10^5$ Pa in increments of $100 \times 10^5$ Pa.

Figure 1:
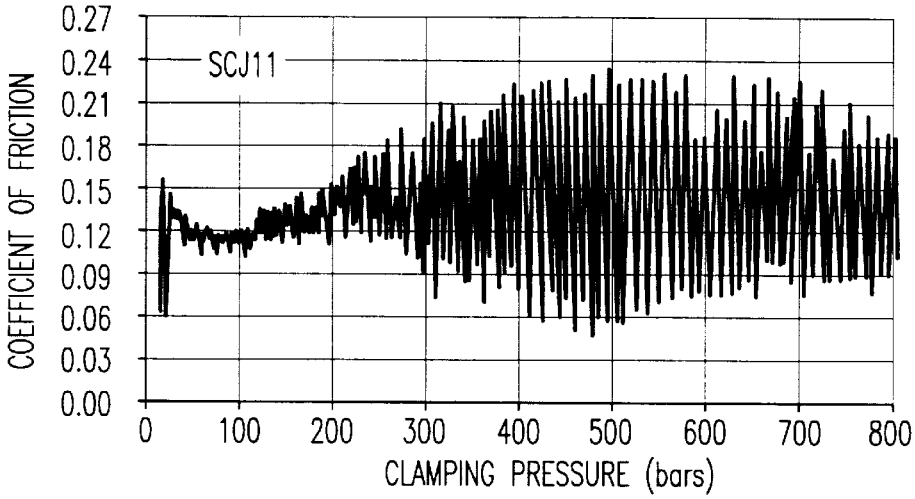
FIGS. 1 to 3, which relate to Example 8 and represent as ordinate the coefficient of plane-to-plane friction of specimens of zinc electroplated sheet

The invention is to achieve, continuously and at high current density, an electrolytic coat based on zinc on a steel strip, to protect it effectively against corrosion while limiting the roughness gain.

The electrodeposition installation is known in itself, and will not be described in detail here; it comprises a succession of electrolysis cells.

Each electrolysis cell comprises a tank, a guide roller for strip support, and soluble anodes of zinc or zinc alloy facing the said roller.

In order to proceed with coating the steel strip, an electrodeposition bath containing zinc ions in solution is prepared.

The electrodeposition bath is a classical bath based on chlorides, which is known in itself and which permits electrodeposition with high yield at elevated current densities, especially higher than 50 A/dm$^2$, or in other words which has, for example, a pH higher than 4 and a concentration of $Zn^{2+}$ ions higher than 1 mole/liter.

According to the invention, there is dissolved in the bath at least one polyethylene glycol polymer with the general formula $R^1$—O—(CH2—CH2—O)$_n$—$R^2$ with $n \leqq 13$, and in which:

either $R^1$ and /or $R^2$ are hydrogen atoms and the said polymer has an average molecular weight lower than 500 g/mole, or $R^1$ and $R^2$ are terminal substituent groups of the chain, which may be different or identical, chosen from among:

the unsubstituted alkyl (—$C_mH_{2m+1}$), alkene (—$C_mH_{2m-1}$) or alkyne (—$C_mH_{2m-3}$) groups, the alkyl ($C_mH_{2m}$—$R^3$), alkene ($C_mH_{2m-2}$—$R^3$) or alkyne ($C_mH_{2m-4}$—$R^3$) groups substituted in terminal position, in which —$R^3$=—O—$R^4$ (ethers or "oxy"), —COO—$R^4$ (esters or "carboxy") or —COOM (carboxylic acid salt), —$SO_3$—$R^4$ ("sulfonyl") or —$SO_3$—M (sulfonic acid salt), —CO—$R^4$ (ketone), —N=$R^4$ or —N<$_{R^5}^{R^4}$ (amine), —S—$R^4$ ("thio"), or —C≡N (nitrile), in which $R^4$, $R^5$ is chosen from among H or an alkyl (—$C_mH_{2m+1}$), alkene (—$C_mH_{2m-1}$) or alkyne (—$C_mH_{2m-3}$) group.

According to the invention, the bath does not contain sulfur-containing organic compounds such as those described as leveling and brightening agents in U.S. Pat. No. 4,229,268.

The electrodeposition bath is circulate din the electrodeposition cells such that the relative velocity of the bath in the vicinity of the strip is higher than 30 m/minute, generally between 80 and 160 m/minute, which corresponds to classical hydrodynamic conditions in industrial production.

The temperature of the electrolysis bath is preferably maintained between 55° C. and 65° C.

The molar concentration of polyethylene glycol dissolved in the bath must be adapted to obtain, under the usage conditions of the bath, a coat based on zinc or zinc alloy incorporating an organic compound in a content higher than 0.1% (expressed as carbon); the examples illustrate the adaption of this concentration in the bath.

The molar concentration of polyethylene glycol dissolved in the bath is preferably between $10^{-4}$ and $10^{-1}$ mole/liter.

Incidentally, the value m in the substituent groups of the polyethylene glycol must be sufficiently low that the polymer is soluble in sufficient concentrations.

to undertake coating of the steel strip, an electric current is passed between the said strip, which constitutes the cathode, and the anodes, while the strip is made to travel through each cell of the installation over the guide rollers.

There is applied a current density high than $0.25 \times J_{lim}$, where $J_{lim}$ is the previously defined limiting current density, which depends on the nature of the zinc electroplating bath and also on the velocity of circulation of the bath in the vicinity of the strip.

For a chloride bath according to the invention circulating at a velocity of between 100 and 150 m/min relative to the strip, the value of $J_{lim}$ is generally close to 140 to 150 A/dm$^2$.

Thus the electric current density must be higher than 35 A/dm$^2$; in practice, it is generally between 50 A/dm$^2$ and 140 A/dm$^2$.

The electrodeposition conditions such as the travel velocity of the steel strip in the installation are also adapted to obtain a coat thickness sufficient for effective protection of the strip against corrosion; this thickness is generally between 3 and 15 micrometers.

In this way there is obtained a steel strip coated with a zinc-based protective layer containing an organic compound which has the same nature as or is derived from the polyethylene glycol contained in the bath according to the invention.

The electrodeposition bath according to the invention permits coats of extremely good quality to be obtained, or in other words coats in which low roughness is accompanied by high corrosion resistance.

This simultaneous effect of leveling and improvement of the specific efficacy of protection against corrosion is achieved by virtue of the polymer product included in the zinc electroplating bath and of the organic compound incorporated in the coat; to achieve this effect, it is important for the carbon content in the coat to be higher than 0.1%.

The coat according to the invention has roughness lower than that which would be found in a coat produced under the same conditions on the same substrate, but with a classical electrodeposition bath not containing this polymer product.

The leveling effect imparted by the polymer product under these conditions of elevated current density is accompanied by a refining effect which imparts a particularly homogeneous coat texture.

The coat according to the invention imparts to the steel strip corrosion resistance that is clearly improved compared with that imparted by a coat of the same thickness comprising pure zinc or pure zinc alloy according to the prior art, prepared under the same conditions from a classical electrodeposition bath not containing this polymer product.

In seeking a predetermined level of protection against corrosion, therefore, it is possible to manage with thinner coats than in the prior art and thus to gain a definite economic benefit.

This reduction of thickness is advantageously accompanied by a decrease in the risks of cracking of the coat (in case of deformation of the sheet).

In addition to this effect of leveling and improvement of the specific efficacy of protection against corrosion, it has been observed that the coats according to the invention exhibit interesting tribological properties and, as regards paintability, offer very strong adherence to the paint layer.

When subjected to friction after oiling, these coats have a considerably lesser stick-slip tendency than identical coats prepared by means of classical zinc electroplating baths.

By virtue of this advantage in tribological properties, the operations of forming, especially deep-drawing, of zinc electroplated sheets are facilitated.

If a paint layer is applied to these coats by electrophoresis, it is found that the paint layer adheres much better than on identical coats prepared by means of classical zinc electroplating baths.

The following examples illustrate the invention:

EXAMPLE 1

The purpose of this example is to illustrate the high degree of protection against corrosion and the small roughness gain that result by using electrodeposition baths according to the invention containing unsubstituted polyethylene glycols.

Specimens cut in the form of disks from bare steel sheet are used.

In a laboratory electrodeposition cell of the rotating electrode type, there is prepared an electrolysis bath according to the following composition:

$Zn^{2+}$ (in the form of ZnCl2) 1.6 mole/liter

KCl 5.3 mole/liter

"PEG 300" polyethylene glycol variable concentration c represented by the general formula $H—O—(CH_2—CH_2—O)_n—H$, where n is between 6 and 7, in which case the average molecular weight is about 300 g.

The pH of the bath is 5 and its temperature is maintained at about 63° C.

The specimen immersed in the bath is then set in rotation at a speed of V=2500 rpm.

A layer of zinc is then deposited on this steel specimen by passing an electric current between the steel sheet constituting the cathode (rotating in this case) and anodes dipping into the bath, such that the current density per unit surface area of the sheet is about J=80 A/dm$^2$, which represents an elevated current density.

This current density is not maintained until the coat achieves a thickness of about 10 $\mu$m.

Table I presents the following information for different concentrations c of PEG 300 in the bath:

the specific efficacy of protection against corrosion that the coat imparts to the sheet; for the present purposes, this efficacy is evaluated by the terms $T_{ps}$ as defined hereinabove; it is considered that the precision in measurement of $T_{ps}$ is on the order of ±0.5 hours/$\mu$m.

the roughness increase $\Delta R_a$ as defined hereinabove; it is considered that the precision in measurement of $\Delta R_a$ is on the order of ±0.01 $\mu$m.

For comparison, the results obtained with a coat prepared in the same way except that the bath contained not PEG 300 but instead a commercial additive known as USSP available from US Steel Corporation are shown in the "reference" row.

TABLE I

Baths containing PEG 300

| Electrolysis bath | Concentration c (mole/liter) | Protection duration $T_{ps}$ (hours/$\mu$m) | Roughness gain $\Delta R_a$ ($\mu$m) |
|---|---|---|---|
| Reference (USSP) | — | 10 | 0.13 |
| PEG 300 | $10^{-3}$ | 14 | 0.06 |
| PEG 300 | $10^{-2}$ | 14 | 0.10 |
| PEG 300 | $3 \times 10^{-2}$ | 15 | |
| PEG 300 | $5 \times 10^{-2}$ | 15 | |

It is therefore obvious that the zinc electroplating bath is capable of limiting the roughness gain when the "PEG 300" concentration is lower than or equal to $10^{-2}$ molar, and that the coat obtained has much better corrosion resistance than the reference coat.

The coat obtained according to the invention has the form of grains of extremely homogeneous size, of about 0.2 $\mu$m, and contains an organic compound which has the same nature as or is derived from the polymer product introduced according to the invention into the zinc electroplating bath.

Comparative Example 1

The purpose of this example is to illustrate the importance of the number n of "ethoxy" radicals of the polyethylene glycol (of formula $H—O—(CH_2—CH_2—O)_n—H$) used in the electrodeposition bath.

The procedure of Example 1 is followed, with the single difference that a "PEG 600" polyethylene glycol is used, the average molecular weight of which is close to 600 and for which n is about 14, or in other words a value higher than the limit provided by the invention.

The results obtained in this case are presented in Table II, in a manner analogous to those in Table I.

TABLE II

| Baths containing PEG 600 | | | |
|---|---|---|---|
| Electrolysis bath | Concentration c (mole/liter) | Protection duration $T_{ps}$ (hours/$\mu$m) | Roughness gain $\Delta R_a$ ($\mu$m) |
| Reference (USSP) | — | 10 | 0.13 |
| PEG 600 | $10^{-3}$ | 10 | |
| PEG 600 | $2.5 \times 10^{-2}$ | 10.25 | |
| PEG 600 | $4.0 \times 10^{-2}$ | 10.1 | |

It is then obvious that the addition of such a polymer in the bath does not have any significant effect on the specific efficacy of protection imparted by the coat.

EXAMPLE 2

The purpose of this example is to illustrate the high degree of protection against corrosion and the small roughness gain that result by using the electrodeposition baths according to the invention containing polyethylene glycols substituted at both ends of the chain.

Coated samples are prepared under the same conditions as in Example 1, with the single difference that PEG 300 is replaced by polyethylene glycol bis(carboxymethyl ether) (or PEGbiCOOH 250) of general formula $R^1$—O—($CH_2$—$CH_2$—O)$_n$—$R^2$, where $R^1$=$R^2$=—CH2—COOH and n=about 3, in which case the average molecular weight is about 250 g/mole.

The results obtained with regard to corrosion resistance ($T_{ps}$) and roughness increase $\Delta R_a$ are presented in Table III below.

TABLE III

| Baths containing PEGbiCOOH 250 | | | |
|---|---|---|---|
| Electrolysis bath | Concentration c (mole/liter) | Protection duration $T_{ps}$ (hours/$\mu$m) | Roughness gain $\Delta R_a$ ($\mu$m) |
| Reference (USSP) | — | 10 | 0.13 |
| PEGbiCOOH 250 | $10^{-2}$ | 13 | 0.08 |
| PEGbiCOOH 250 | $5 \times 10^{-2}$ | 15 | 0.06 |

As in Example 1, it is therefore obvious that the zinc electroplating bath is capable of limiting the roughness gain, at least for "PEGbiCOOH 250" concentrations of between 1 and $5\times10^{-2}$ molar, and that the coat obtained has better corrosion resistance than the reference coat.

EXAMPLE 3

The purpose of this example is to illustrate the high degree of protection against corrosion and the small roughness gain that result by using the electrodeposition baths according to the invention containing polyethylene glycols substituted at both ends of the chain, but with a degree of polymerization higher than that of Example 2.

Coated samples are prepared under the same conditions as in Example 2, with the single difference that PEGbiCOOH 250 is replaced by "PEGbiCOOH 600", a product of the same general formula but with a higher degree of polymerization, for which n=about 11, in which case the average molecular weight M is about 600 g/mole.

The results obtained with regard to corrosion resistance ($T_{ps}$) and roughness increase $\Delta R_a$ are presented in Table IV below.

TABLE IV

| Baths containing PEGbiCOOH 600 | | | |
|---|---|---|---|
| Electrolysis bath | Concentration c (mole/liter) | Protection duration $T_{ps}$ (hours/$\mu$m) | Roughness gain $\Delta R_a$ ($\mu$m) |
| Reference (USSP) | — | 10 | 0.13 |
| PEGbiCOOH 600 | $0.5 \times 10^{-3}$ | 12.5 | −0.15 |
| PEGbiCOOH 600 | $10^{-3}$ | 12.5 | −0.05 |

It is therefore obvious that, under the conditions of use of the electrodeposition bath and in the case of polyethylene glycol polymers of "PEGbiCOOH" type, a reduction of roughness after deposition is achieved, even for very low concentrations, while at the same time the specific efficacy of protection of the coat against corrosion is increased.

EXAMPLE 4

The purpose of this example is to illustrate the degree of incorporation of the organic compound in the protective coats according to the invention.

On an aluminum specimen considered to be a "non-adhering" substrate, a "pre-deposit" of zinc having a thickness of 3 $\mu$m is prepared under the same conditions as those of Example 3, with the single difference that polyethylene glycol is not included in the zinc electroplating bath.

Electrodeposition in baths identical to those of Example 3 is continued on top of this pre-deposit until a thickness of about 100 $\mu$m is obtained.

The obtained coat is detached from its aluminum substrate in order to determine the total carbon contained in the coat; by virtue of the pre-deposit, the substrate is isolated from any polymer that may be contained in this coat.

The carbon contained in the coat is then determined by means of a classical carbon-determination instrument comprising an induction furnace (commercial designation: LECO HF-100) coupled to an infrared analyzer.

The results obtained are presented in Table V.

TABLE V

| PEGbiCOOH 600 baths - carbon ratio in the coat | | |
|---|---|---|
| Electrolysis bath | Concentration c (mole/liter) | Weight ratio of C in the coat in % |
| Reference (USSP) | — | — |
| PEGbiCOOH 600 | $0.5 \times 10^{-3}$ | from 0.1 to 0.4% |
| PEGbiCOOH 600 | $10^{-3}$ | from 0.5 to 1% |

The coat obtained according to the invention therefore contains carbon—therefore an organic compound—in a significant quantity, proportional to the concentration of polyethylene glycol polymer included in the zinc electroplating bath according to the invention.

This evaluation of the incorporation of an organic compound in the coat according to the invention does not make it possible to account for specific incorporation phenomena of the substrate-coat interface (contrary to Example 7).

EXAMPLE 5

The purpose of this example is to illustrate the importance of the usage conditions of the zinc electroplating baths according to the invention for the coat properties in terms of corrosion resistance and roughness gain ($\Delta R_a$).

Baths identical to those of Example 2 are prepared, containing, according to the invention, PEGbiCOOH 250 in different concentrations.

Steel specimens in the form of plates having a surface area of about 300 cm2 are used this time.

To prepare coats from these baths, this time an electrodeposition cell is used in which the specimen (plate) is placed in fixed position facing the anode and in which the zinc electroplating bath is circulated between the specimen, which acts as cathode, and the anode at a constant flow velocity of 150 m/minute.

The specimens are thus coated with a zinc-based layer of thickness on the order of 10 $\mu$m using current densities of between 50 and 140 A/dm$^2$.

For these zinc electroplating baths and their conditions of flow velocity relative to the surface to be coated, it is estimated that the value of the limiting current density $J_{lim}$ is close to 140 A/dm$^2$.

The 50 to 140 A/dm$^2$ range of current densities therefore corresponds well to a range in which the coat roughness depends substantially on the substrate roughness ("peak effect") and not on grain size.

For each coated specimen, evaluations are made of the resistance to cosmetic corrosion, in addition to the resistance of perforating corrosion ($T_{ps}$) and the roughness gain ($\Delta R_a$) as previously.

To perform tests of resistance to cosmetic corrosion on these coated specimens, it is advisable to pain them beforehand in standard manner: this painting operation classically comprises a phosphating treatment, followed by application of a first layer of paint by cataphoresis, then of a second layer as primer and finally of a third coat in the form of lacquer.

After this standardized paint application, a score mark is made on the coated and painted sheet by means of a standardized device adapted to create a score mark with a width of about 0.5 mm down to the level of the metal of the sheet.

In order to evaluate the resistance to cosmetic corrosion, the coated, painted and scored specimens are then subjected to climatic cycles.

Each elementary cycle lasts one week and is subdivided as follows:

- 24 hours under salt fog in the climate chamber (according to French Standard NF 41-002), then rinsing with doubly ion-exchanged water and wiping dry,
- 4 days in the climate chamber, subdivided as follows:
  - from 09:00 am to 05:00 pm: 40° C. and 95 to 100% relative humidity,
  - from 05:00 pm to 09:00 am: 20° C. and 70 to 75% relative humidity,
- 2 days in the drying chamber: 20° C. and 60 to 65% humidity.

The mean width of degradation of the score mark, or in other words the "blistering width", is observed and measured on each specimen, in the present case after 14 thermal cycles.

The resistance to cosmetic corrosion can be evaluated on the basis of this blistering width: narrower width corresponds to better corrosion resistance.

The results obtained in terms of corrosion resistance (protection time $T_{ps}$ and blistering width) and of roughness gain ($\Delta R_a$) are presented in Tables VI, VII, VIII and IX below for current densities of J=50, 80, 110 and 140 A/dm$^2$ respectively.

TABLE VI

Baths containing PEGbiCOOH 250 - J = 50 A/dm2

| Electrolysis bath | Concentration (mole/liter) | Protection $T_{ps}$ (h/$\mu$m) | Blistering width (mm) | Roughness gain $\Delta R_a$ ($\mu$m) |
|---|---|---|---|---|
| Reference (USSP) | — | 10.2 | 1.5 | 0.10 |
| PEGbiCOOH 250 | $10^{-2}$ | 12.4 | 1.5 | 0.00 |
| PEGbiCOOH 250 | $5 \times 10^{-2}$ | 14.5 | 1 | 0.10 |

TABLE VII

Baths containing PEGbiCOOH 250 - J = 80 A/dm2

| Electrolysis bath | Concentration (mole/liter) | Protection $T_{ps}$ (h/$\mu$m) | Blistering width (mm) | Roughness gain $\Delta R_a$ ($\mu$m) |
|---|---|---|---|---|
| Reference (USSP) | — | 10.5 | 1.5 | 0.18 |
| PEGbiCOOH 250 | $10^{-2}$ | 12.4 | 1.75 | 0.08 |
| PEGbiCOOH 250 | $5 \times 10^{-2}$ | 14.0 | 1.25 | 0.18 |

TABLE VIII

Baths containing PEGbiCOOH 250 - J = 110 A/dm2

| Electrolysis bath | Concentration (mole/liter) | Protection $T_{ps}$ (h/$\mu$m) | Blistering width (mm) | Roughness gain $\Delta R_a$ ($\mu$m) |
|---|---|---|---|---|
| Reference (USSP) | — | 10.6 | 1.5 | 0.27 |
| PEGbiCOOH 250 | $10^{-2}$ | 12.0 | 1.75 | 0.15 |
| PEGbiCOOH 250 | $5 \times 10^{-2}$ | 13.0 | 1.0 | 0.27 |

TABLE IX

Baths containing PEGbiCOOH 250 - J = 140 A/dm2

| Electrolysis bath | Concentration (mole/liter) | Protection $T_{ps}$ (h/$\mu$m) | Blistering width (mm) | Roughness gain $\Delta R_a$ ($\mu$m) |
|---|---|---|---|---|
| Reference (USSP) | — | 10.7 | 1.5 | 0.28 |
| PEGbiCOOH 250 | $10^{-2}$ | 12.4 | 1.75 | 0.20 |
| PEGbiCOOH 250 | $5 \times 10^{-2}$ | 13.0 | 0.75 | 0.28 |

In the "reference" row it is clear that the roughness gain increases with current density, from 0.1 $\mu$m at 50 A/dm$^2$ to 0.27 to 0.28 $\mu$m at 110 A/dm2 and above.

These results indicate that, compared with the reference under the same conditions of current density, the roughness gain decreases appreciably at a "PEGbiCOOH 250" concentration of $10^{-2}$ *molar* in the bath, but remains comparable to the reference for a higher concentration ($5\times10^{-2}$ molar); it is therefore advisable to adapt the polymer concentration in the bath in order to optimize the leveling effect.

Example 2 indicates for the same additive, "PEGbiCOOH 250", that the roughness gain decreases at a concentration of $10^{-2}$ molar and in particular that it decreases even more strongly (albeit without reaching 0.1 $\mu$m) at a higher concentration ($5\times10^{-2}$ molar).

It is therefore deduced that the optimum concentration of leveling agent according to the invention ("PEGbiCOOH 250" in this case) depends on its usage conditions.

The examples illustrating the invention show that, for the polymer concentration in the zinc electroplating bath according to the invention, there exists a "threshold" effect above which the roughness gain brought about by the coat no longer decreases as a function of concentration; this threshold effect has already been described elsewhere for leveling agents other than those of the invention, such as tetrabutylammonium chloride (M. Sanchez Cruz, F. Alonso, J. M. Palacios, in J. of Applied Electrochemistry, Vol. 20, 1990, p. 611: "The effect of the concentration of TBACl on the electrodeposition of zinc from chloride and perchlorate electrolytes").

As regards corrosion resistance, the results in Tables VI to IX show that:

under the bath usage conditions of this example, the specific efficacy of protection against perforating corrosion of the coats ($T_{ps}$) depends little on the current densities at which they were produced (provided the condition $J>0.25\times J_{lim}$ was always met), but essentially on the concentration of polymer in the zinc electroplating bath, which is related to the concentration of organic compound incorporated into the coat itself (according to Examples 4 and 6).

the resistance to cosmetic corrosion (inversely proportional to the blistering width) is identical to or poorer than that of the reference for a "PEGbiCOOH 250" concentration of $10^{-2}$ molar in the bath, but improves significantly for a higher concentration ($5\times10^{-2}$ molar); since the result of this test is also indicative of the paintability of specimens coated by cataphoresis (see adherence tests: Example 9), it is still difficult to draw specific conclusions on corrosion resistance therefrom.

EXAMPLE 6

The purpose of this example is to illustrate the effect of concentration of polymer of polyethylene glycol type in the zinc electroplating bath on the roughness gain ($\Delta R_a$), on the specific protection efficacy ($T_{ps}$) and on the degree of incorporation of organic compound in the obtained coat (C ratio) by using in this case the electrodeposition device of Example 5 under the following conditions:

bath temperature: approximately 63° C., velocity of electrolyte flow against the sheet to be coated: 100 m/min, current density: 80 A/dm$^2$, deposit thickness: 8 to 10 $\mu$m.

The reference bath contains 5.3 mole/liter of potassium chloride (KCl), 1.6 mole/liter of zinc chloride($ZnCl_2$) and 0.7 to 1 ml/liter of reference additive USSP of the US Steel Corporation.

This USSP additive contains essentially polyethylene glycol of average molecular weight close to 600, together with sodium benzoate and boric acid.

Besides the reference bath, the zinc electroplating baths used in accordance with the invention are prepared by addition of polyethylene glycol polymer to this reference bath.

The quantity of polyethylene glycol introduced by the USSP additive into these baths is very much smaller than that added further to the baths according to the invention.

Figure 4:
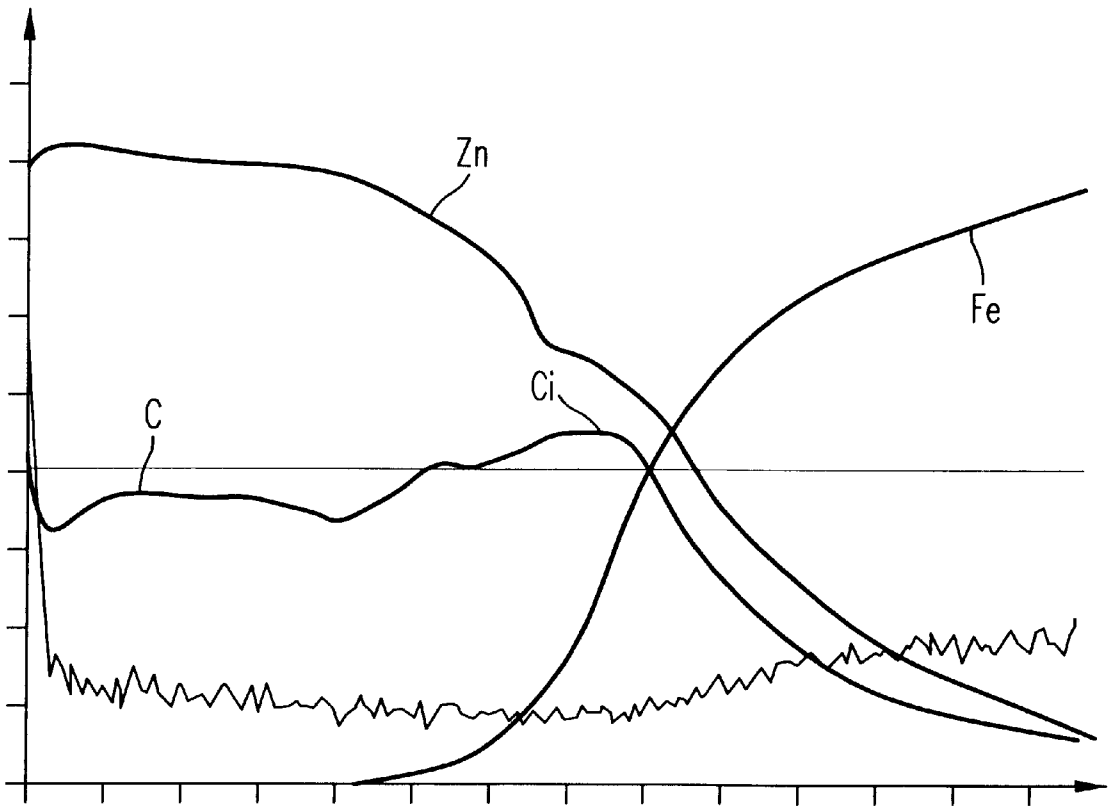
FIG. 4, which relates to Example 6 and represents a "GDS" spectrum (Glow Discharge Spectroscopy) of a steel specimen coated with zinc according to the invention, the curves Zn, C and Fe respectively representing the content (ordinate) of Zn, C and Fe in the depth of the coat (abscissa).

The carbon content in the coat is evaluated in this case by glow discharge spectroscopy ("GDS"); a spectrum as shown in FIG. 4 is then obtained.

The ordinate of this spectrum corresponds to the concentration of element and the abscissa to the erosion depth.

Referring now to FIG. 4, glow discharge spectroscopy shows the variation in the depth of the specimen, starting from the coated surface, of the content of zinc (signal "Zn", decreasing at the coat-substrate interface), of the content of iron (signal "Fe", increasing at the coat-substrate interface) and of the carbon content (signal "C").

The carbon content in the coat is evaluated by measuring the area under the curve formed by the signal "C".

It is noted that curve "C" forms a peak at "Ci", which is positioned around the interface between the zinc coat and the steel sheet; this peak "Ci" corresponds to an excessive concentration of organic compound at the interface.

The carbon content in the thickness of the coat, excluding the steel-zinc interface, is evaluated by measuring the area under the curve formed by signal "C", without taking peak "Ci" into account.

The results obtained are presented as a function of the nature and concentration c of polymer in the electrolysis bath in Table X for coats of 10 $\mu$m thickness and in Table XI for coats of 8 $\mu$m thickness.

TABLE X

PEGbiCOOH baths - 10 $\mu$m coats

| Electrolysis bath | Conc. c (mole/liter) | C content (in %) | Protec. dur. $T_{ps}$ (h/$\mu$m) | Roughness gain $\Delta R_a$ ($\mu$m) |
|---|---|---|---|---|
| Reference (USSP) | — | 0.05% | 11 | 0.28 |
| PEGbiCOOH 600 | $0.5\times10^{-3}$ | 0.5% | 11 | 0.10 |
| PEGbiCOOH 600 | $1.5\times10^{-3}$ | 0.65% | 11.5 | 0.04 |
| PEGbiCOOH 600 | $2.0\times10^{-3}$ | 0.8% | 13 | 0.02 |
| PEGbiCOOH 600 | $3.0\times10^{-3}$ | 1% | 13.5 | 0.08 |
| PEGbiCOOH 250 | $5\times10^{-2}$ | 0.3% | 14 | 0.16 |

TABLE XI

PEGbiCOOH baths - 8 $\mu$m coats

| Electrolysis bath | Conc. c (mole/liter) | C content (in %) | Protec. dur. $T_{ps}$ (h/$\mu$m) | Roughness gain $\Delta R_a$ ($\mu$m) |
|---|---|---|---|---|
| Reference (USSP) | — | — | 9 | 0.23 |
| PEGbiCOOH 600 | $0.5\times10^{-3}$ | — | 11.8 | 0.12 |
| PEGbiCOOH 600 | $2.0\times10^{-3}$ | — | — | 0.08 |
| PEGbiCOOH 600 | $3.0\times10^{-3}$ | — | 13.0 | 0.11 |
| PEGbiCOOH 250 | $5\times10^{-2}$ | — | 13.8 | 0.13 |

As regards the roughness gain, it is noted:

that the results for "PEGbiCOOH 250" differ from those of Example 5: this difference could be due to the fact that USSP commercial additive is present in the baths of Example 6 but absent from the baths of Example 5.

that the results for "PEGbiCOOH 600", by comparison with those of Example 3, show that—as for "PEGbiCOOH 250" (see conclusions of Example 5)—there exists an "optimum" polymer concentration in the bath ("threshold effect"), and that the value of this optimum in this case depends not only on its usage conditions but also on other constituents of the bath (for example, the USSP additive).

As regards the carbon content in the coat, it is seen that the "PEGbiCOOH 600" product yields coats richer in carbon than the "PEGbiCOOH 250" product: this difference is not as large if the incorporation in the coat is expressed in terms of "number of polymer molecules or chains".

EXAMPLE 7

The purpose of this example is to illustrate the influence of zinc electroplating current density and polyethylene glycol concentration in the baths according to the invention on the degree and location of incorporation or organic compound in the zinc coats obtained.

Specimens are prepared under the same conditions as in Example 6 (zinc electroplating baths containing added "PEGbiCOOH 600", thickness 10 $\mu$m) at difference current densities (20 to 140 A/dm$^2$) and the carbon content incorporated in the coats obtained is evaluated as in Example 6.

Figure 5:
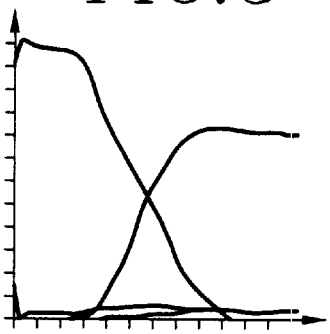
FIGS. 5 to 15, which relate to Example 7 and represent "GDS" spectra of steel specimens coated with zinc, each spectrum comprising three curves, as in FIG. 4.
Figure 8:
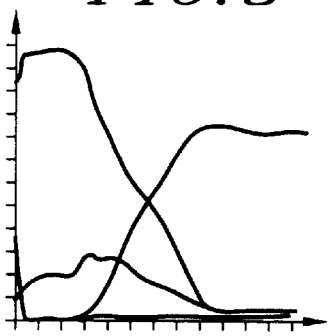
Figure 12:
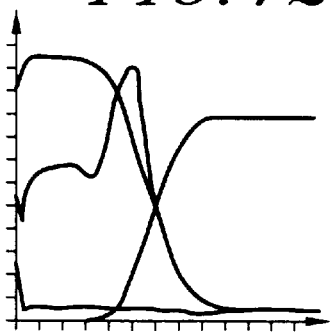
Figure 6:
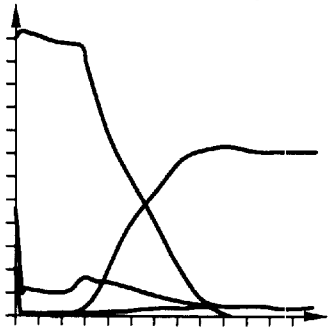
Figure 9:
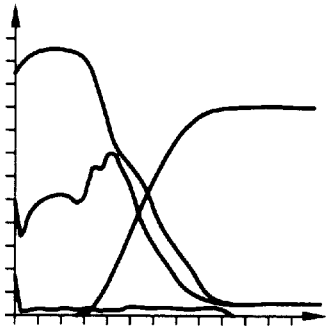
Figure 13:
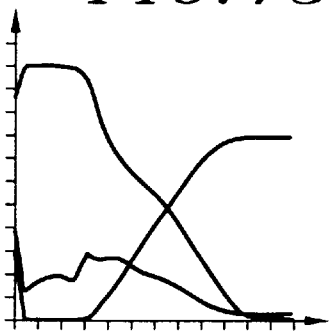
Figure 7:
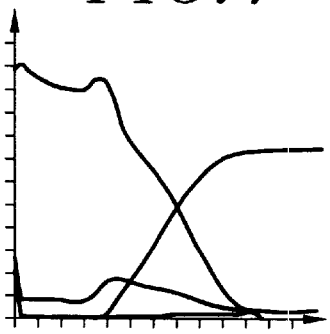
Figure 10:
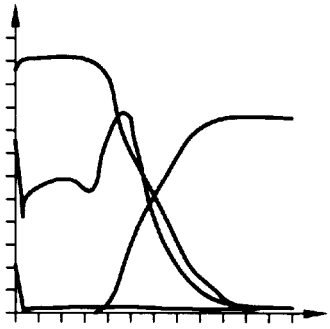
Figure 14:
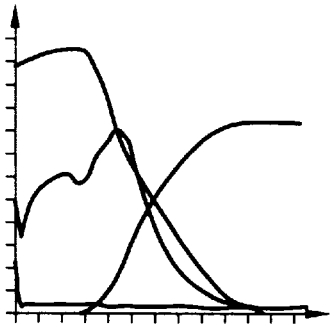
Figure 11:
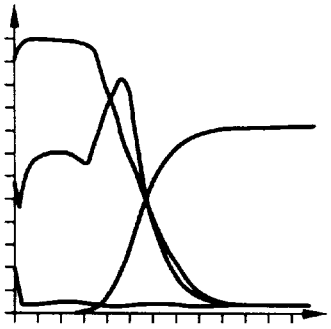
Figure 15:
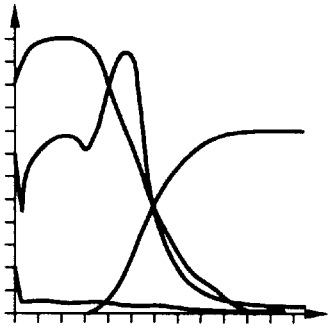

The "GDS" spectra of the coats obtained are shown in a manner similar to that of FIG. 4:

- in FIGS. 5, 6, 7 for the reference bath, at 20, 80 and 140 A/dm$^2$ respectively.
- in FIGS. 8 to 12 for baths containing $1\times10^{-3}$ mole/liter of "PEGbiCOOH 600", at 20, 50, 80, 110 and 140 A/dm$^2$ respectively.
- in FIGS. 13 to 15 for baths containing $2\times10^{-3}$ mole/liter of "PEGbiCOOH 600", at 20, 50 and 80 A/dm$^2$ respectively.

The curve of carbon content is plotted on each figure to allow comparison of those figures with that of FIG. 4, described in detail in Example 6.

The results obtained are summarized in Table XII.

TABLE XII

Incorporation of organic compound in the coat

| Zinc electroplating bath | | | | | | |
|---|---|---|---|---|---|---|
| Additive | Conc. c M/l | Concentration C in coat, % | | | | |
| Reference | — | ≈0% | — | 0.05 | — | 0.05% |
| PEGbiCOOH 600 | $1\times10^{-3}$ | 0.20 | 0.40 | 0.55 | 0.70 | 0.80 |
| PEGbiCOOH 600 | $2\times10^{-3}$ | 0.25 | 0.50 | 0.60 | — | — |
| Current density (A/dm2) | | 20 | 50 | 80 | 110 | 140 |

Table XII shows that the current density and the concentration of polyethylene glycol polymer in the bath affect the quantity of organic compound incorporated in the coat.

The influence of concentration of polyethylene glycol polymer in the bath had already been illustrated by Example 4 for an elevated current density (80 A/dm$^2$).

At low current density (20 A/dm$^2$) (FIGS. 8 and 13), the coat incorporates little organic compound.

For higher current densities ($J>0.25\times J_{lim}$), the evolution of incorporation of organic compound as a function of current density differs depending on whether incorporation is taking place in the depth of the coat or at the coat-steel interface, as illustrated in FIGS. 9 to 12, 14 and 15; in FIG. 12, the carbon concentration at the interface reaches almost double the carbon concentration in the depth of the coat (see peak "Ci" of FIG. 4, very pronounced here).

The following deductions can be made from these results:

- the carbon content in the thickness of the layer outside the steel-zinc interface zone (zone of peak ("Ci") increases with current density then remains almost constant above a current density of between 80 and 110 A/dm$^2$ ("threshold effect");
- the carbon content at the steel-zinc interface (height of peak "Ci") increases steadily with current density, without threshold effect.

By comparing FIGS. 8 to 12 and FIGS. 13 to 15, it is clear that the threshold concentration of carbon in the thickness of the layer is higher at a "PEGbiCOOH 600" concentration of $2\times10^{-3}$ M/l than of $1\times10^{-3}$ M/l; as it happens, the results of Tables X and XI (Example 6) relating to this polymer reveal a larger improvement of the specific efficacy of protection against corrosion ($T_{ps}$) as soon as the carbon content in the coat exceeds 0.65%; it is estimated that, in this case, the carbon content, measured only in the thickness of the said layer and outside the steel-layer interface zone, is higher than or equal to 0.5 wt %; this "carbon content in the thickness of the layer outside the steel-layer interface zone" is evaluated by measuring the area under curve "C" without taking into account the interface peak "Ci".

EXAMPLE 8

The purpose of this example is to illustrate the influence of the polymer additive introduced into the electrodeposition baths according to the invention and of the incorporation of this polymer in the electrodeposited coat formed from the bath on the tribological properties of the coat.

The tribological tests are performed in a classical tribometer adapted to measure the coefficient of "plane-to-plane" friction of a specimen against a "standard" surface by progressively increasing the pressure with which the specimen is clamped against the surface.

All specimens are coated as in Example 7 at a current density of 80 A/dm$^2$.

Prior to the friction test, all specimens are oiled in the same way using 4107S oil of the FUCHS Co., which is not considered to be an oil specially adapted for deep drawing.

Figure 2:
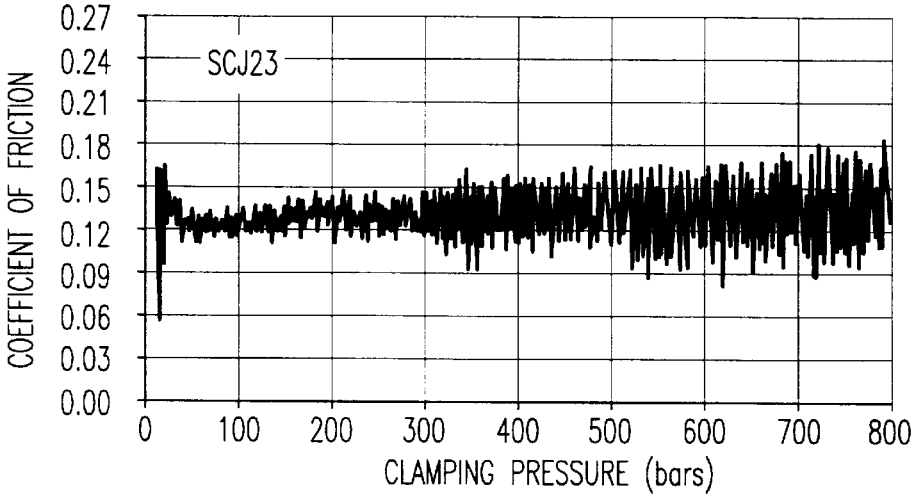
Figure 3:
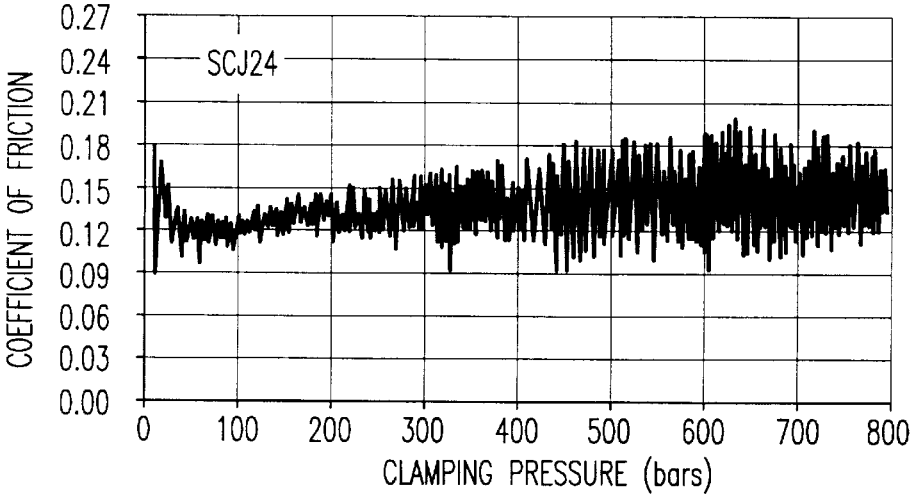

The results obtained are presented in FIGS. 1 to 3 and summarized in Table XIII.

TABLE XIII

Tribological properties of the coat

| Zinc electroplating bath | | see | Coefficient of friction | | |
|---|---|---|---|---|---|
| Additive | Conc. c M/l | FIG. | min. | mean | max. |
| Reference | — | 1 | 0.05 | 0.14 | 0.23 |
| PEGbiCOOH 600 | $2\times10^{-3}$ | 2 | 0.06 | 0.13 | 0.18 |
| PEGbiCOOH 250 | $5\times10^{-2}$ | 3 | 0.09 | 0.14 | 0.20 |

It is therefore noted, especially upon analysis of the figures, that the addition of polyethylene glycol to the electrodeposition bath according to the invention makes it possible to produce zinc-based coats having better tribological properties; in fact, the friction on coats according to the invention has much lesser stick-slip tendency than the friction on a classical coat produced from the same bath but without additive.

This advantage is particularly valuable for forming of zinc electroplated sheets, especially by deep drawing.

EXAMPLE 9

The purpose of this example is to illustrate the exceptional characteristics of adherence to paints offered by the coats based on zinc or zinc alloys produced according to the invention, especially in the case of paints applied by electrophoresis.

Two types of zinc-plated specimens are prepared under conditions analogous to those of Example 6:

- reference specimens (USSP only as additive in the zinc electroplating bath),
- specimens according to the invention in a bath to which $1\times10^{-3}$ mole/liter of "PEGbiCOOH 600" is added.

These samples are coated with paint by cataphoresis under two different conditions:

- method 1: phosphating (thickness 3 $\mu$m) then coating;
- method 2: direct coating, without preliminary phosphating.

The coating conditions are identical in the two methods: in particular, the same cataphoresis bath (PPG 742 of the PPG Co.) is used.

Paint adherence tests are then performed as follows on the painted specimens:

the painted specimens are immersed in double ion-exchanged water at 50° C. for 10 days;

then, after drying, a cutter-type tool is used to make in the paint layer score marks deep enough to reach the metal under the paint; in fact, a square grid of score marks is made on a surface area of 1 cm2 of specimen, the lines of the score marks being equidistant about 1 mm from each other.

the part of the specimen surface containing this square grid is then deformed as follows: as in an "Erichsen" test, a hemispherical punch (diameter 20 mm) with polished head is pressed onto the face opposite the square rid and forced in to a depth of 8 mm, while the specimen is immobilized in an annular die (blank holder).

a self-adhesive plastic tape ("Scotch" type) is pressed onto the square grid at the deformation location;

the tape is then stripped off and the proportion of the surface no longer covered by the paint layer at the position of the square grid is measured.

The results obtained are presented in Table XIV.

TABLE XIV

Paint adherence tests

| Electrolysis bath | Paint application conditions. | % of surface uncovered after adherence test |
|---|---|---|
| Reference (USSP) | method 1 | 90 to 100% |
| " | method 2 | 100% |
| PEGbiCOOH at $1 \times 10^{-3}$ M/I | method 1 | 0% |
| " | method 2 | 40% |

It is therefore obvious that the paint layers, especially when applied by cataphoresis, adhere very strongly to the coat based on zinc or zinc alloys when they are produced from electrodeposition baths according to the invention.

EXAMPLE 10

The purpose of this example is to demonstrate that the introduction of certain additives into the electrodeposition baths, in addition to the polyethylene glycol according to the invention, has the effect of negating or appreciably limiting the effects of the invention, especially as regards incorporation of organic compound in the coat and as regards improvement of the specific efficacy of protection of this coat.

Deposits of 10 $\mu$m thickness are produced under the same conditions as in Example 6, using the following different baths:

bath No. 1: reference bath identical to that of Example 6, bath No. 2 in accordance with the invention, prepared from bath No. 1 by adding $2\times10^{-3}$ mole/liter of "PEGbiCOOH 600", No. 3, in accordance with the already cited U.S. Pat. No. 5,575,899, prepared from bath No. 2 by adding 1 g/l of sodium thiosulfate as "compound possessing a lone pair of electrons".

The results obtained in terms of specific protection efficacy $T_{ps}$, of incorporation of organic compound in the coat (C ratio in arbitrary units or "a.u.", from measurements of the area under peak "Ci" of the "GDS" curve of carbon content analogous to that in FIG. 4), and of morphology of the coat are presented in Table XV.

The degree of incorporation of sulfur ("S ratio") in the coat was also evaluated in arbitrary units ("a.u.") by glow discharge spectroscopy, using the same measurement method as for carbon ("C ratio").

TABLE XV

Influence of other additives on the coat and its properties

| Bath | Protect. dur. $T_{ps}$ (h/$\mu$m) | C ratio (in a.u.) | S ratio (in a.u.) | Morphology of the coat |
|---|---|---|---|---|
| No. 1 | 10.5 | ≦0.5 | 0.2 | homogeneous and refined |
| No. 2 | 13.5 | 2.0 | 0.2 | homogeneous and highly refined (flakes) |
| No. 3 | 11.4 | ≦0.5 | 3.0 | heterogeneous: refined zones and non-refined zones |

It is deduced from these results that the introduction into the bath according to the invention of a "compound possessing a lone pair of electrons" such as sodium thiosulfate has completely inhibited the incorporation of organic compound in the coat (the carbon ratio is identical to that of the reference) and has led to loss of the improvement of specific efficacy of protection of the coat.

This therefore argues against using the electrodeposition baths described in U.S. Pat. No. 5,575,899 for working the invention.

It is noted at the same time that bath No. 3 incorporates a sulfur compound instead of and in place of the organic compound according to the invention.

EXAMPLE 11

The purpose of this example is to illustrate the use of electrodeposition baths according to the invention for deposition of zinc alloy, in the present case an alloy of zinc and nickel.

The reference bath (No. 1) used contains the following elements:

zinc chloride ($ZnCl_2$): 2.8 mole/liter; nickel chloride: 0.35 M/l.

potassium chloride (KCl): 4.36 M/l.

Two baths according to the invention are prepared by adding to bath No. 1:

No. 2: 0.5 g/l of "PEGbiCOOH 600",

No. 3: 1.0 g/l of "PEGbiCOOH 600".

Starting from these baths, and using the electrodeposition device of Example 5, Zn—Ni coats are prepared under the following conditions:

current density: 2 conditions: 50 and 70 A/dm$^2$, electrolyte flow velocity relative to the conditions: 2 levels: 100 m/min and 150 m/min.

All coats obtained exhibit the same nickel content (13% to 14% by weight), showing that the polymer added to the bath in accordance with the invention ("PEGbiCOOH 600" in the present case) does not influence the content of alloy element (nickel in the present case) in the coat.

The effect achieved by use of the bath according to the invention is therefore entirely different from that imparted by the polyoxyalkylene compounds of European Patent 0285931 (already cited) or by the polymeric additives described in European Patent 0342585 in zinc-chromium alloy electrodeposition baths, which are designed to increase the content of chromium in the coat.

Furthermore, for all deposition conditions according to this example, the coats obtained exhibit very good adherence to the substrate (the adherence test comprises folding the coated sheet by 180°, applying Scotch® adhesive tape to the fold line then stripping off the tape, and examining the coat removed by stripping).

French patent application 97 07985 is incorporated herein by reference.

What is claimed is:

1. An aqueous electrodeposition bath based on chlorides for preparation of a coat based on zinc or zinc alloy, wherein the pH is higher than 4, wherein the molar concentration of ions of zinc or zinc alloy is higher than 1 mole/liter, which does not contain any compound possessing a lone pair of electrons chosen among the group consisting of sodium thiosulfate, nicotinic acid, urea, thiourea, nicotinamide and thioglycolic acid, which contains in solution at least one polyethylene glycol polymer of general formula $R^1$—O—($CH_2$—$CH_2$—O)$_n$—$R^2$, wherein;

1) firstly, n≦13, 2) secondly, the concentration of the said polymer in the bath is adapted to incorporate in the said coat an organic compound in a content greater than 0.65 wt %, expressed as weight of carbon per unit weight of the said coat, and thirdly:

$R^1$ and/or $R^2$ are hydrogen atoms and the said polymer has an average molecular weight lower than 500 g/mole, or $R^1$ and $R^2$ are terminal substituent groups of the chain, and may be different or identical, chosen from the group consisting of:

unsubstituted alkyl (—$C_mH_{2m+1}$), alkene (—$C_mH_{2m-1}$) or alkyne (—$C_mH_{2m-3}$) groups, alkyl ($C_mH_{2m}$—$R^3$), alkene ($C_mH_{2m-2}R^3$) or alkyne ($C_mH_{2m-4}R^3$) groups substituted in terminal position, in which $R^3$=—O—$R^4$, —COO—$R^4$ or COOM, $SO_3$—$R^4$ or —$SO_3$—M, CO—$R^4$, —N═$R^4$ or —$N_{R^5}^{R^4}$, —S—$R^4$, or —C≡N, in which $R^4$, $R^5$ are chosen from the group consisting of H, alkyl (—$C_mH_{2m+1}$), alkene (—$C_mH_{2m-1}$) and alkyne (—$C_mH_{2m-3}$) group, the value of m being sufficiently low that the said polymer is soluble at the said concentration in the bath, wherein during electrodeposition, the bath is operated at a current density of between 50 and 150 A/dm$^2$.

2. A zinc electroplating bath according to claim 1, wherein the average molecular weight M of the said polymer is greater than 150 g/mole.

3. A zinc electroplating bath according to claim 1 or 2 wherein the concentration of the said polymer in the said bath is between $10^{-4}$ and $10^{-1}$ mole/liter.

4. A zinc electroplating bath according to claims 1 or 2 wherein $R^1$ and $R^2$ are hydrogen atoms.

5. A zinc electroplating bath according to claims 1 or 2 wherein $R^1$=$R^2$=—$CH_2$—COOH.

6. A process for electrodeposition of a coat based on zinc or zinc alloy on a strip of steel sheet wherein:

the said sheet is made to travel through an electrodeposition bath according to claim 1, and an electrodeposition electric current is passed between the said strip acting as cathode and at least one anode disposed in the said bath opposite the said strip, characterized in that the mean current density, measured on the portion of the said strip facing the at least one anode, is higher than $0.25 \times J_{lim}$, where $J_{lim}$ is the limiting current density, which corresponds to the current density plateau on the characteristic "intensity-potential" curve of the said zinc electroplating bath for a given velocity of travel of the said strip relative to that bath.

7. A process according to claim 6, wherein the said coat is based on zinc.

8. A steel sheet coated with a corrosion protection layer based on zinc or zinc alloy prepared by the process according to claim 6 or 7 wherein the said layer contains more than 0.65 wt % (expressed as carbon) of an organic compound.

9. A steel sheet according to claim 8, wherein, in the thickness of the said layer and outside the steel-layer interface zone, the carbon content is higher than or equal to 0.5 wt %.

* * * * *